US011170643B1

(12) United States Patent
Carter

(10) Patent No.: US 11,170,643 B1
(45) Date of Patent: Nov. 9, 2021

(54) TRAFFIC LIGHT APPROACH INTERVENING SAFETY SYSTEM

(71) Applicant: Leonard Carter, Rockmart, GA (US)

(72) Inventor: Leonard Carter, Rockmart, GA (US)

( * ) Notice: Subject to any disclaimer, the term of this patent is extended or adjusted under 35 U.S.C. 154(b) by 0 days.

(21) Appl. No.: 16/984,269

(22) Filed: Aug. 4, 2020

(51) Int. Cl.
*G08G 1/087* (2006.01)
*G08G 1/095* (2006.01)
*G08G 1/09* (2006.01)

(52) U.S. Cl.
CPC ..... *G08G 1/087* (2013.01); *G08G 1/094* (2013.01); *G08G 1/095* (2013.01)

(58) Field of Classification Search
CPC ..... G08G 1/087; G08G 1/094; G08G 1/095; G06K 19/0723; G06K 1/07749
See application file for complete search history.

(56) References Cited

U.S. PATENT DOCUMENTS 5,083,125 A * 1/1992 Brown ..... G08G 1/087 340/902
D430,054 S 8/2000 McMullen
6,339,382 B1 1/2002 Arbinger
6,980,125 B1 12/2005 Barber
7,113,108 B1 * 9/2006 Bachelder ..... G08G 1/042 340/906
8,094,040 B1 1/2012 Cornett
8,723,680 B1 5/2014 Baker
10,163,342 B2 12/2018 Kweon
10,332,393 B1 6/2019 Chang
10,720,053 B1 * 7/2020 Clanney ..... G08G 1/07
2007/0040700 A1 * 2/2007 Bachelder ..... G08G 1/087 340/902
2010/0153002 A1 * 6/2010 Lee ..... G08G 1/087 701/533
2011/0193722 A1 * 8/2011 Johnson ..... G08G 1/087 340/906
2015/0138000 A1 * 5/2015 Hartman ..... G08B 21/18 340/906
2019/0088120 A1 * 3/2019 Adireddy ..... G08G 1/087
2019/0130738 A1 * 5/2019 Yu ..... G08G 1/162
2021/0012656 A1 * 1/2021 Davis, Jr. ..... G08G 1/095

* cited by examiner

*Primary Examiner* — Andrew W Bee
(74) *Attorney, Agent, or Firm* — Kyle A. Fletcher, Esq.

(57) ABSTRACT

The traffic light approach intervening safety system is a safety device that is configured for use in traffic control. The traffic light approach intervening safety system includes a traffic control signal and an emergency vehicle. The traffic light approach intervening safety system establishes a communication link between the traffic control signal and the emergency vehicle that indicates to the traffic control signal that the emergency vehicle is in the vicinity of the traffic control signal. Upon receipt of the indication of the presence of the emergency vehicle, the traffic light approach intervening safety system overrides the normal operation of the traffic control signal with a plurality of visually distinct signals that direct the flow of traffic such that a path is cleared for the passage of the emergency vehicle.

17 Claims, 4 Drawing Sheets

TRAFFIC LIGHT APPROACH INTERVENING SAFETY SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of signaling and traffic control systems, more specifically, an override of a traffic control signal. (G08G1/087)

SUMMARY OF INVENTION

The traffic light approach intervening safety system is a safety device. The traffic light approach intervening safety system is configured for use in traffic control. The traffic light approach intervening safety system comprises a traffic control signal and an emergency vehicle. The traffic control signal and the emergency vehicle are defined elsewhere in this disclosure. The traffic light approach intervening safety system establishes a communication link between the traffic control signal and the emergency vehicle that indicates to the traffic control signal that the emergency vehicle is in the vicinity of the traffic control signal. Upon receipt of the indication of the presence of the emergency vehicle, the traffic light approach intervening safety system overrides the normal operation of the traffic control signal with a plurality of visually distinct signals that direct the flow of traffic such that a path is cleared for the passage of the emergency vehicle.

These together with additional objects, features and advantages of the traffic light approach intervening safety system will be readily apparent to those of ordinary skill in the art upon reading the following detailed description of the presently preferred, but nonetheless illustrative, embodiments when taken in conjunction with the accompanying drawings.

In this respect, before explaining the current embodiments of the traffic light approach intervening safety system in detail, it is to be understood that the traffic light approach intervening safety system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the traffic light approach intervening safety system.

It is therefore important that the claims be regarded as including such equivalent construction insofar as they do not depart from the spirit and scope of the traffic light approach intervening safety system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
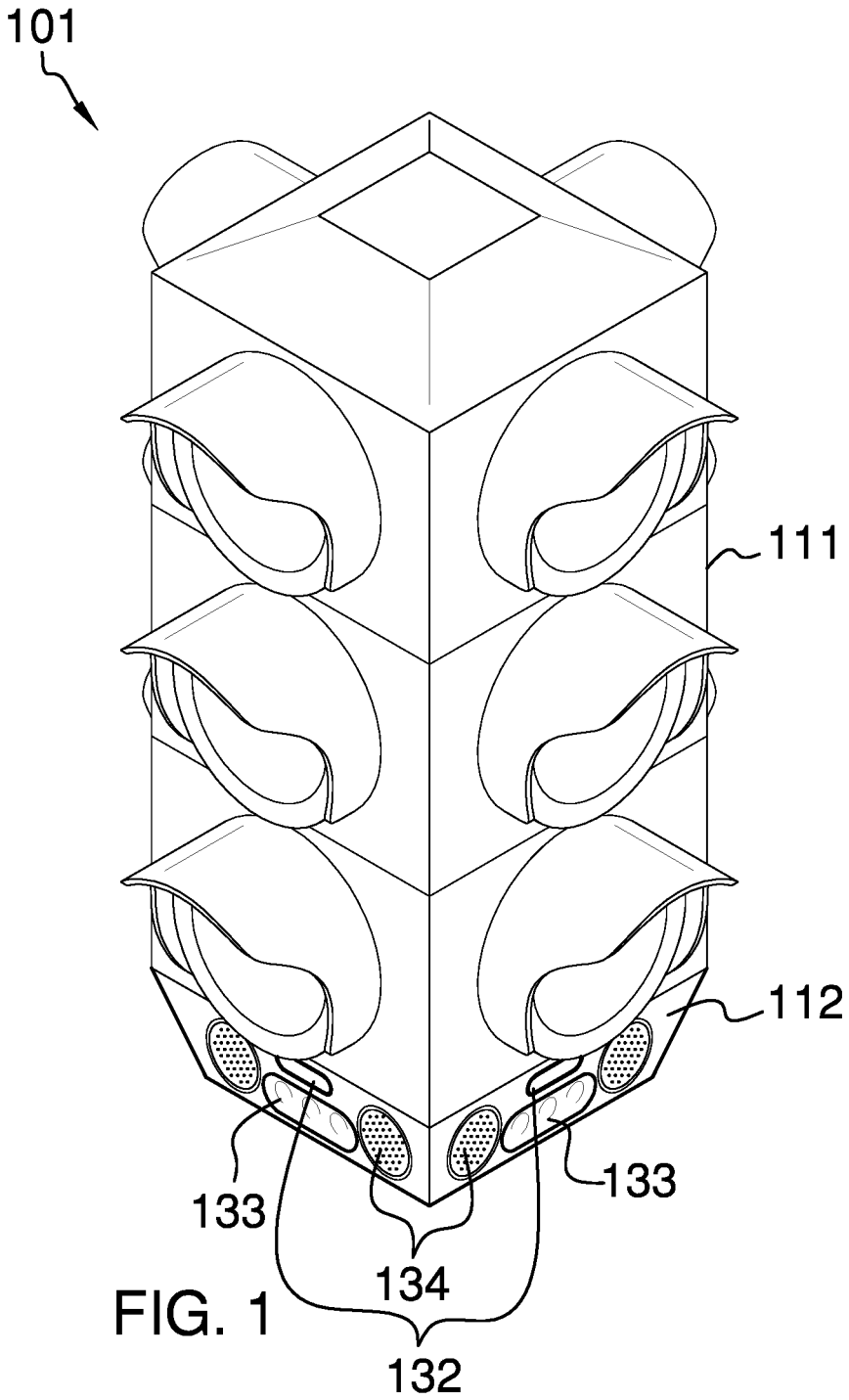
FIG. 1 is a perspective view of an embodiment of the disclosure.
Figure 2:
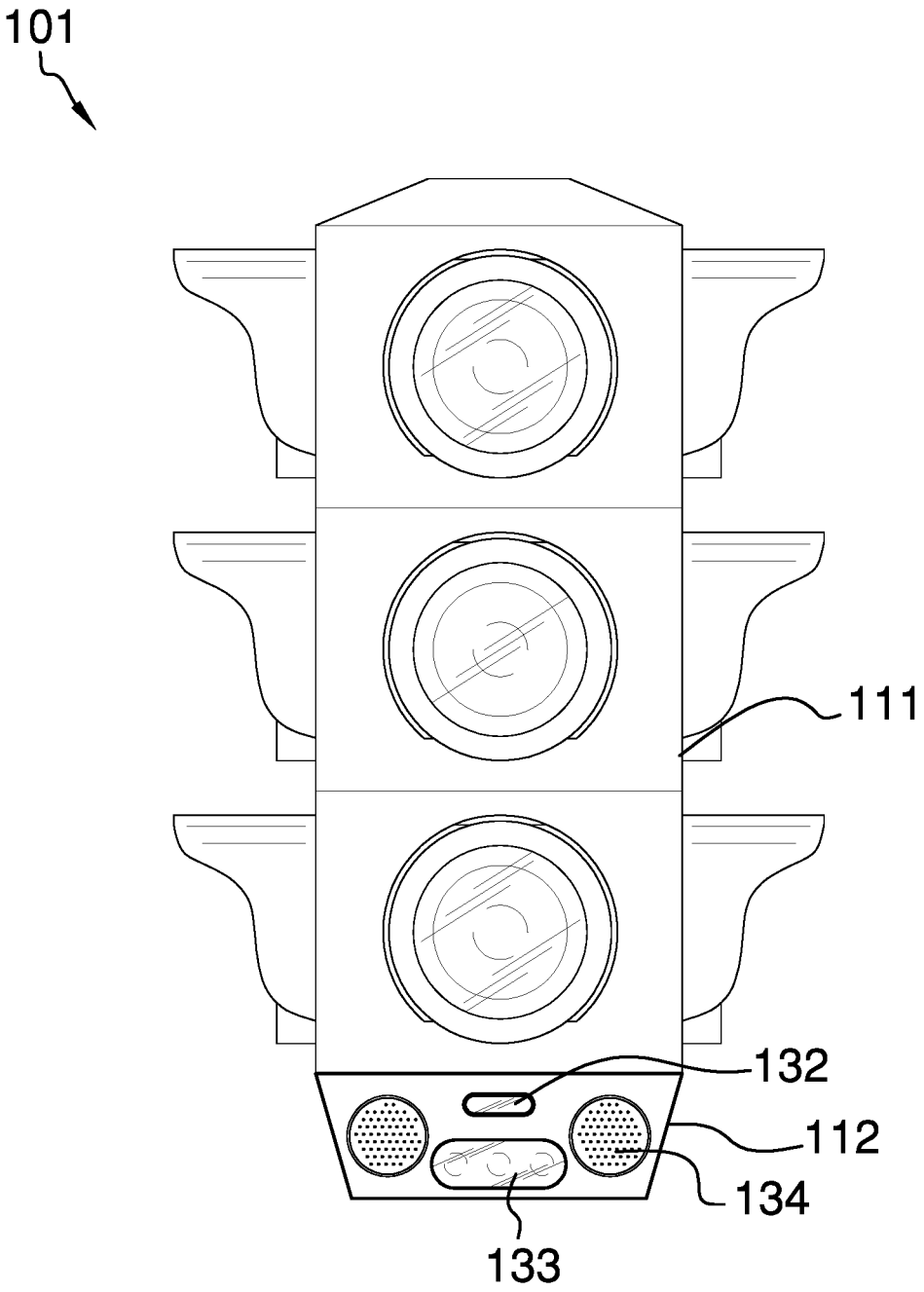
FIG. 2 is a front view of an embodiment of the disclosure.
Figure 3:
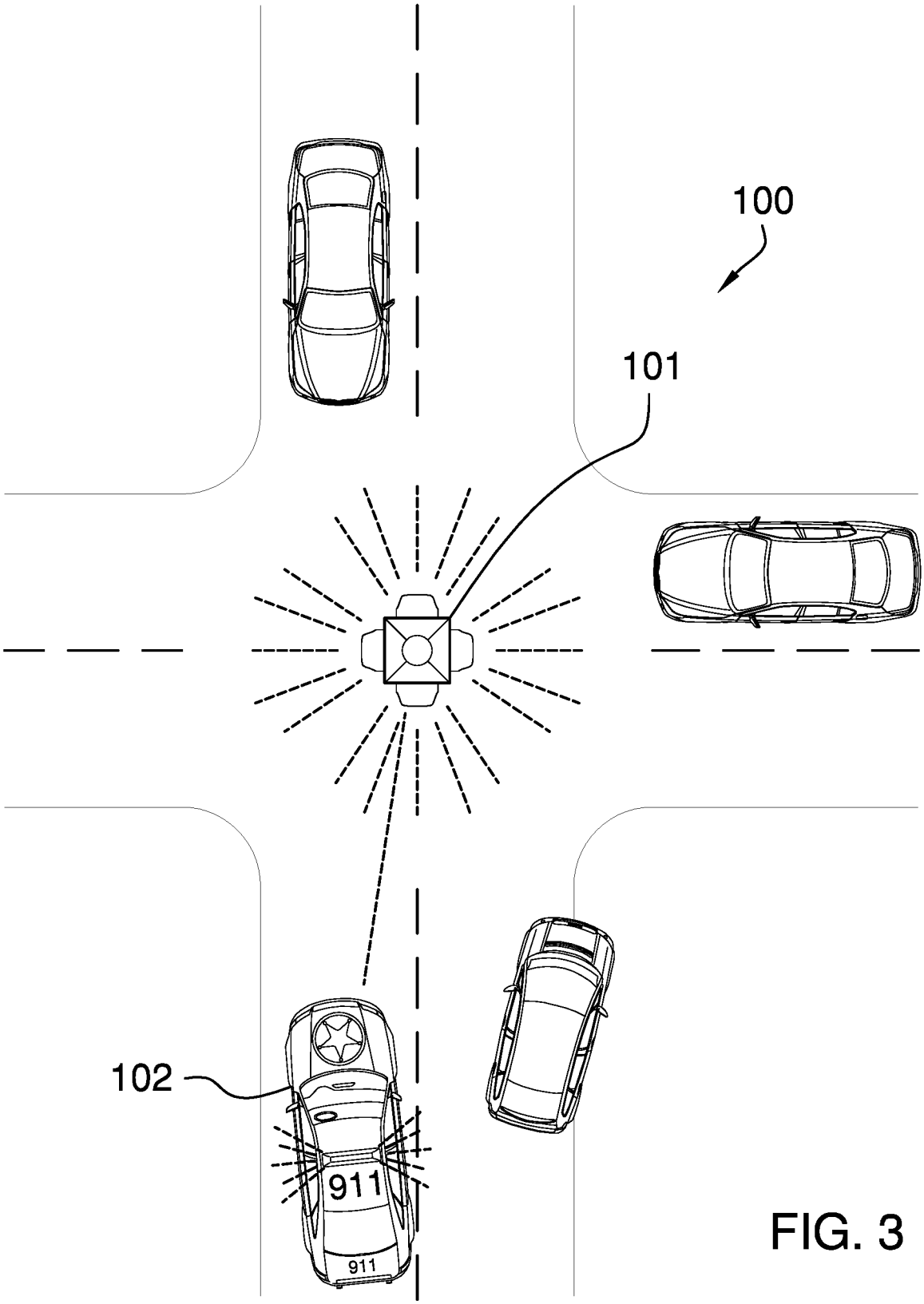
FIG. 3 is an in-use view of an embodiment of the disclosure.
Figure 4:
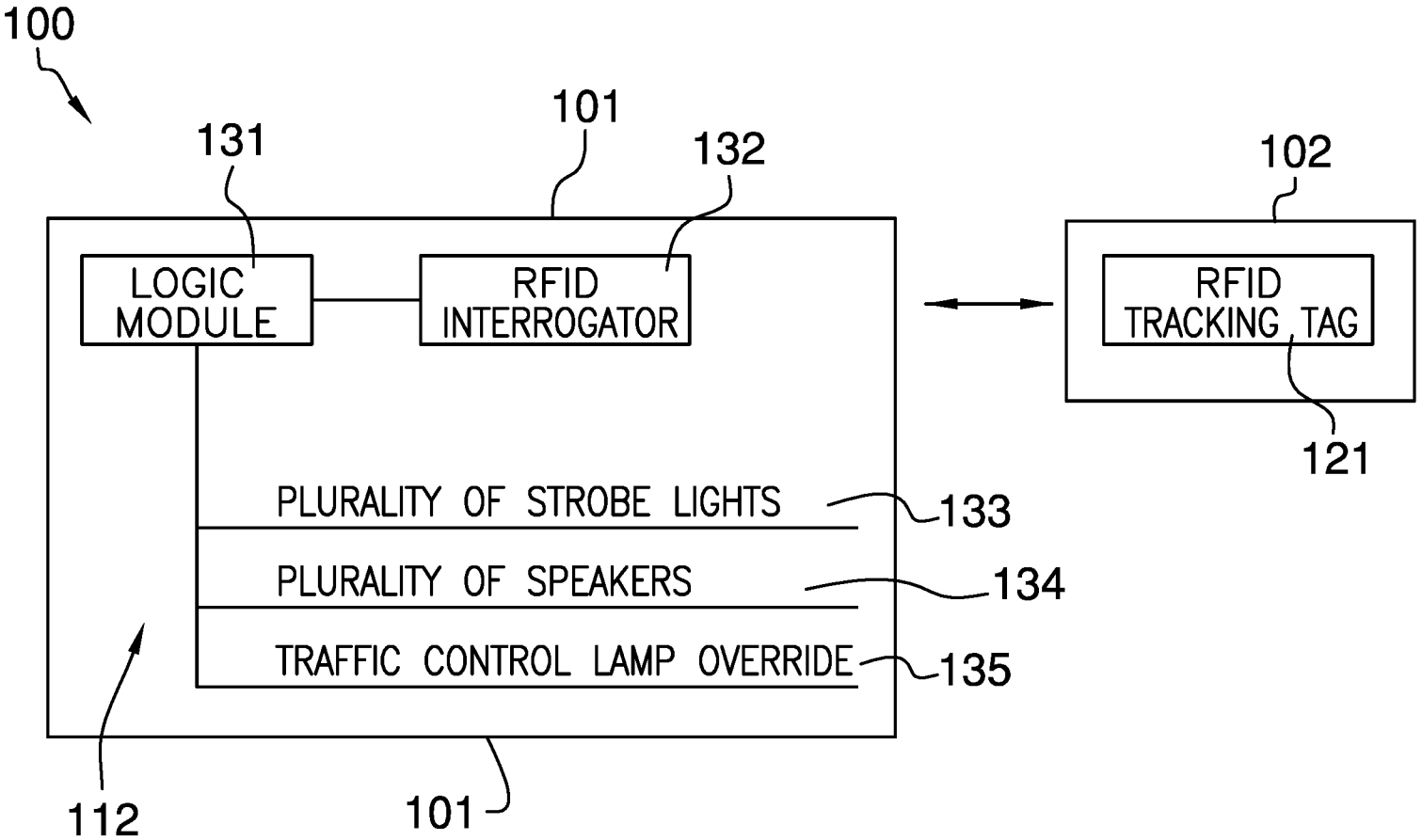
FIG. 4 is a block diagram of an embodiment of the disclosure.

Detailed reference will now be made to one or more potential embodiments of the disclosure, which are illustrated in FIGS. 1 through 4.

The traffic light approach intervening safety system 100 (hereinafter invention) is a safety device. The invention 100 is configured for use in traffic control. The invention 100 comprises a traffic control signal 101 and an emergency vehicle 102. The traffic control signal 101 and the emergency vehicle 102 are defined elsewhere in this disclosure. The invention 100 establishes a communication link between the traffic control signal 101 and the emergency vehicle 102 that indicates to the traffic control signal 101 that the emergency vehicle 102 is in the vicinity of the traffic control signal 101. Upon receipt of the indication of the presence of the emergency vehicle 102, the invention 100 overrides the normal operation of the traffic control signal 101 with a plurality of visually distinct signals that direct the flow of traffic such that a path is cleared for the passage of the emergency vehicle 102.

The emergency vehicle 102 is a vehicle that operates with special privileges on a road network. The emergency vehicle 102 is commonly used by an appropriate authority to rapidly respond to a situation. The emergency vehicle 102 further comprises an RFID tracking tag 121.

The RFID tracking tag 121 is an electric circuit. The RFID tracking tag 121 is housed within the emergency vehicle 102. The RFID tracking tag 121 draws electric power from the emergency vehicle 102. The RFID tracking tag 121 detects the broadcast of the microwave wavelength signal of electromagnetic radiation generated by the override circuit 112 of the traffic control signal 101. The RFID tracking tag 121 transmits an amplified reflection of the detected microwave wavelength signal of electromagnetic radiation back to override circuit 112 of the traffic control signal 101 to indicate that the emergency vehicle 102 is in the vicinity. The RFID tracking tag 121 is defined elsewhere in this disclosure.

The traffic control signal 101 is an electrically powered device. The traffic control signal 101 is a device that supervises the flow of traffic past a point. The traffic control signal 101 generates a plurality of visual signals used to supervise the flow of traffic past the point in an orderly fashion. The traffic control signal 101 broadcasts a microwave wavelength signal of electromagnetic radiation. The traffic control signal 101 detects any response generated by an emergency vehicle 102 that detects the signal broadcast by the traffic control signal 101. Upon detection of a response signal, the traffic control signal 101 overrides its normal traffic supervision functions to generate a plurality of visual indications that effectively clear a path past the point controlled by the traffic control signal 101 for the emergency vehicle 102. The traffic control signal 101 comprises a signal control structure 111 and an override circuit 112.

The signal control structure 111 is an electrical device that performs the primary traffic control functions of the traffic control signal 101. The signal control structure 111 generates a plurality of visual signals used to supervise the flow of traffic past the controlled point in an orderly fashion. The primary functions of the signal control structure 111 are defined elsewhere in this disclosure.

The override circuit 112 is an electric circuit. The override circuit 112 is housed within the signal control structure 111. The override circuit 112 draws electric power from the signal control structure 111. The override circuit 112 broadcasts a microwave wavelength signal of electromagnetic radiation at regular intervals. The override circuit 112 detects any response generated by an emergency vehicle 102 that detects the signal broadcast by the override circuit 112. Upon detection of a response signal, the override circuit 112 overrides the normal traffic supervision functions of the signal control structure 111 to cause signal control structure 111 to generate the plurality of visual indications that effectively clear a path past the point controlled by the emergency vehicle 102. The override circuit 112 comprises a logic module 131, an RFID interrogator 132, a plurality of strobe lights 133, a plurality of speakers 134, and a signal control structure 111 override signal 135.

The logic module 131, the RFID interrogator 132, the plurality of strobe lights 133, the plurality of speakers 134, and the signal control structure 111 override signal 135 are electrically interconnected.

The logic module 131 is an electric circuit. The logic module 131 electrically connects to the signal control structure 111. The logic module 131 controls the operation of the override circuit 112.

The logic module 131 manages the interface between the override circuit 112 and the signal control structure 111. The logic module 131 controls the operation of the RFID interrogator 132. The logic module 131 initiates the broadcast of a microwave wavelength signal of electromagnetic radiation by the RFID interrogator 132. The logic module 131 initiates the broadcast of the microwave wavelength signal of electromagnetic radiation at regular intervals. The logic module 131 monitors the RFID interrogator 132 to detect when a responding signal from an emergency vehicle 102 has been detected by the RFID interrogator 132.

The logic module 131 controls the operation of the plurality of strobe lights 133. The logic module 131 initiates the operation of the plurality of strobe lights 133 when the logic module 131 detects that the RFID interrogator 132 has detected a responding signal from the emergency vehicle 102.

The logic module 131 controls the operation of the plurality of speakers 134. The logic module 131 initiates the operation of the plurality of speakers 134 when the logic module 131 detects that the RFID interrogator 132 has detected a responding signal from the emergency vehicle 102.

The logic module 131 generates the signal control structure 111 override signal 135 transmitted to the signal control structure 111 when the logic module 131 detects that the RFID interrogator 132 has detected a responding signal from the emergency vehicle 102.

The RFID interrogator 132 is an electric circuit. The RFID interrogator 132 is an RFID based transceiver. The RFID interrogator 132 broadcasts the microwave wavelength signal of electromagnetic radiation used to initiate a response from the RFID tracking tag 121 of any emergency vehicle 102 in the vicinity of the traffic control signal 101. The RFID interrogator 132 receives the responding signal generated by the RFID tracking tag 121 in every emergency vehicle 102 in the vicinity of the traffic control signal 101. The RFID interrogator 132 electrically connects to the logic module 131 such that the logic module 131 detects that the RFID interrogator 132 has detected a responding signal from an emergency vehicle 102.

Each of the plurality of strobe lights 133 is a strobe light. The strobe light is defined elsewhere in this disclosure. In the first potential embodiment of the disclosure, each of the plurality of strobe lights 133 generates a visible light. The plurality of strobe lights 133 generate the visible signals to indicate that an emergency vehicle 102 is in the vicinity of the traffic control signal 101. The plurality of strobe lights 133 are mounted on the exterior surface of the traffic control signal 101. Each of the plurality of strobe lights 133 is positioned such that at least one light selected from the plurality of strobe lights 133 is visible from any direction relative to the traffic control signal 101.

Each of the plurality of speakers 134 is a transducer. Each of the plurality of speakers 134 is a speaker. Each of the plurality of speakers 134 receives an electric signal from the logic module 131. Each of the plurality of speakers 134 generates an audible sound. The plurality of speakers 134 generate the audible signals to indicate that an emergency vehicle 102 is in the vicinity of the traffic control signal 101. Each of the plurality of speakers 134 is mounted on the exterior surface of the traffic control signal 101. Each of the plurality of speakers 134 is positioned such that generated audible signal is audible from any direction relative to traffic control signal 101.

The signal control structure 111 override signal 135 is an electrical signal. The logic module 131 transmits the signal control structure 111 override signal 135 to the signal control structure 111 when the logic module 131 detects that the RFID interrogator 132 has detected a responding signal from the emergency vehicle 102. The signal control structure 111 override signal 135 initiates the signal control structure 111 to halt the movement of all traffic at the point supervised by the traffic control signal 101.

The following definitions were used in this disclosure:

Appropriate Authority: As used in this disclosure, an appropriate authority is a previously determined person or organization that is designated to monitor compliance with, and if necessary enforce, regulatory and legal mandates.

Broadcast: As used in this disclosure, a broadcast refers to a radio frequency transmission intended to be received by a plurality of receivers.

Electromagnetic Radiation: As used in this disclosure, electromagnetic radiation refers to an interaction between electric fields and magnetic fields that is capable of transmitting energy through a vacuum.

Emergency Vehicle: As used in this disclosure, an emergency vehicle is a vehicle that is operated on a road network by an appropriate authority. The emergency vehicle is equipped with visible and audible alarms and markings that indicate that the emergency vehicle operates as a privileged vehicle under traffic regulations and that other vehicles operating on the road network are required yield their rights under the traffic regulations to the emergency vehicle.

Filtering Material: As used in this disclosure, a filtering material refers to an object or material that prevents or inhibits the passage of radiation of specific wavelengths through the object or material.

Lamp: As used in this disclosure, a lamp is an electrical circuit that generates (typically visible spectrum) electromagnetic radiation.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Microwave Radiation: As used in this disclosure, infrared radiation refers to electromagnetic radiation with a wavelength in the approximate range of 1 millimeter to 30 centimeter.

Radiation: As used in this disclosure, radiation refers to the discharge of energy from an object. The term is often applied to energy in the form of: a) waves, such as electromagnetic radiation or acoustic energy; b) nuclear radiation such as alpha, beta, and gamma, particle radiation; and, c) gravitational waves. The radiation of electromagnetic waves is often classified by the wavelength of the generated waves, such as ultraviolet and infrared radiation.

Receiver: As used in this disclosure, a receiver is an electric device that is used to receive and demodulate electromagnetic radiation such as radio signals.

RFID: As used in this disclosure, RFID refers to Radio Frequency Identification technology. RFID is a wireless technology that uses electromagnetic fields to identify and retrieve data from tracking tags that are placed on or near an object.

RFID Interrogator: As used in this disclosure, an RFID interrogator is a device that transmits a radio signal at frequency designed to activate RFID tracking tags that are tuned to operate at that frequency.

RFID Tracking Tag: As used in this disclosure, an RFID tracking tag is a reflective antenna that receives a radio signal from an RFID Interrogator and uses the energy received from the RFID interrogator signal to reflect a modified signal back to the RFID interrogator. The modified signal generally contains identification information about the RFID tag. The RFID interrogator receives and records these reflected signals. RFID tags are generally tuned to respond to a specific frequency. The RFID tracking tag as described to this point is a passive, or unpowered RFID tracking tag. There are also available within RFID technology active, or powered, RFID tracking tags. An active RFID tracking tag acts as a beacon that actively transmits identification information in a manner that can be received and recorded by an RFID interrogator. Within this disclosure, both passive and active RFID tracking tags are used.

Speaker: As used in this disclosure, a speaker is an electrical transducer that converts an electrical signal into an audible sound.

Strobe Light: As used in this disclosure, a strobe light is a device that is used to generate flashes of light at regular intervals. The strobe light is often referred to as a strobe.

Supervision: As used in this disclosure, supervision refers to an individual or system that observes and provides direction for the operation of: a) one or more individuals; or, b) a process.

Tinted: As used in this this disclosure, a tinted object is a first object made of first transparent material that has been coated, treated, or processed with a second material that reduces the amount of light that passes through the transparent material of the first object while not significantly scattering the light that passes through the first transparent material such that object behind the first object would remain clearly visible.

Traffic: As used in this disclosure, traffic refers to the simultaneous movement of a plurality of vehicles and pedestrians.

Traffic Control: As used in this disclosure, traffic control refers to a system of rules and signals that supervise the flow of traffic over a road network.

Traffic Control Signal: As used in this disclosure, a traffic control signal is an electrically powered device. The traffic control signal generates one or more visually distinct signals used for directing and controlling traffic flow through a location. A traffic control signal is often called a traffic light.

Transceiver: As used in this disclosure, a transceiver is a device that is used to generate, transmit, and receive electromagnetic radiation such as radio signals.

Transducer: As used in this disclosure, a transducer is a device that converts a physical quantity, such as pressure or brightness into an electrical signal or a device that converts an electrical signal into a physical quantity.

Transmitter: As used in this disclosure, a transmitter is a device that is used to generate and transmit electromagnetic radiation such as radio signals.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor.

Visually Distinct: As used in this disclosure, visually distinct is a comparative term between the perceived color of a first object and the perceived color of a second object. The second object is said to be visually distinct from the first object if the delta E between the measured CIELAB color specification of the first object and the measured CIELAB color specification of the second object is greater than 1.5. As a practical matter, most people would consider a delta E of greater than 1.5 to be different colors under almost any light source.

With respect to the above description, it is to be realized that the optimum dimensional relationship for the various components of the invention described above and in FIGS.

1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A safety system for approaching a traffic light comprising a traffic control signal and an emergency vehicle;

wherein the traffic control signal is a device that supervises the flow of traffic past a point;

wherein the emergency vehicle is a vehicle that operates with special privileges on a road network;

wherein the safety system for approaching a traffic light is configured for use in traffic control;

wherein the emergency vehicle further comprises an RFID tracking tag;

wherein the RFID tracking tag is an electric circuit that is housed within the emergency vehicle;

wherein the RFID tracking tag draws electric power from the emergency vehicle;

wherein the traffic control signal broadcasts a microwave wavelength signal of electromagnetic radiation;

wherein the traffic control signal comprises a signal control structure and an override circuit;

wherein the RFID tracking tag transmits an amplified reflection of the detected microwave wavelength signal of electromagnetic radiation back to the override circuit of the traffic control signal to indicate that the emergency vehicle is in the vicinity.

2. The safety system for approaching a traffic light according to claim 1 wherein the safety system for approaching a traffic light establishes a communication link between the traffic control signal and the emergency vehicle that indicates to the traffic control signal that the emergency vehicle is in the vicinity of the traffic control signal;

wherein upon receipt of the indication of the presence of the emergency vehicle, the safety system for approaching a traffic light overrides the normal operation of the traffic control signal with a plurality of visually distinct signals that direct the flow of traffic such that a path is cleared for the passage of the emergency vehicle.

3. The safety system for approaching a traffic light according to claim 2 wherein the traffic control signal is an electrically powered device;

wherein the traffic control signal generates a plurality of visual signals used to supervise the flow of traffic past the point in an orderly fashion;

wherein the traffic control signal detects any response generated by an emergency vehicle that detects the signal broadcast by the traffic control signal;

wherein upon detection of a response signal, the traffic control signal overrides its normal traffic supervision functions to generate a plurality of visual indications that clear a path past the point controlled by the traffic control signal for the emergency vehicle.

4. The safety system for approaching a traffic light according to claim 3;

wherein the override circuit electrically connects to the signal control structure;

wherein the override circuit is housed within the signal control structure.

5. The safety system for approaching a traffic light according to claim 4 wherein the RFID tracking tag detects the broadcast of the microwave wavelength signal of electromagnetic radiation generated by the override circuit of the traffic control signal.

6. The safety system for approaching a traffic light according to claim 5 wherein the signal control structure is an electrical device that performs the primary traffic control functions of the traffic control signal;

wherein the signal control structure generates a plurality of visual signals used to supervise the flow of traffic past the controlled point in an orderly fashion.

7. The safety system for approaching a traffic light according to claim 6 wherein the override circuit is an electric circuit;

wherein the override circuit draws electric power from the signal control structure;

wherein the override circuit broadcasts a microwave wavelength signal of electromagnetic radiation at regular intervals;

wherein the override circuit detects any response generated by an emergency vehicle that detects the signal broadcast by the override circuit;

wherein upon detection of a response signal, the override circuit overrides the normal traffic supervision functions of the signal control structure to cause signal control structure to generate the plurality of visual indications that clear a path past the point controlled by the emergency vehicle.

8. The safety system for approaching a traffic light according to claim 7 wherein the override circuit comprises a logic module, an RFID interrogator, a plurality of strobe lights, a plurality of speakers, and a signal control structure override signal;

wherein the logic module, the RFID interrogator, the plurality of strobe lights, the plurality of speakers, and the signal control structure override signal are electrically interconnected.

9. The safety system for approaching a traffic light according to claim 8 wherein the logic module is an electric circuit;

wherein the logic module electrically connects to the signal control structure;

wherein the logic module controls the operation of the override circuit;

wherein the logic module manages the interface between the override circuit and the signal control structure.

10. The safety system for approaching a traffic light according to claim 9 wherein the logic module controls the operation of the RFID interrogator;

wherein the logic module controls the operation of the plurality of strobe lights;

wherein the logic module controls the operation of the plurality of speakers;

wherein the logic module generates the signal control structure override signal transmitted to the signal control structure when the logic module detects that the RFID interrogator has detected a responding signal from the emergency vehicle;

wherein the logic module initiates the broadcast of a microwave wavelength signal of electromagnetic radiation by the RFID interrogator;

wherein the logic module initiates the broadcast of the microwave wavelength signal of electromagnetic radiation at regular intervals;

wherein the logic module monitors the RFID interrogator to detect when a responding signal from an emergency vehicle has been detected by the RFID interrogator.

11. The safety system for approaching a traffic light according to claim 10 wherein the logic module initiates the operation of the plurality of strobe lights when the logic module detects that the RFID interrogator has detected a responding signal from the emergency vehicle.

12. The safety system for approaching a traffic light according to claim 11 wherein the logic module initiates the operation of the plurality of speakers when the logic module detects that the RFID interrogator has detected a responding signal from the emergency vehicle.

13. The safety system for approaching a traffic light according to claim 12 wherein the RFID interrogator is an electric circuit;

wherein the RFID interrogator is an RFID based transceiver;

wherein the RFID interrogator broadcasts the microwave wavelength signal of electromagnetic radiation used to initiate a response from the RFID tracking tag of any emergency vehicle in the vicinity of the traffic control signal;

wherein the RFID interrogator receives the responding signal generated by the RFID tracking tag in every emergency vehicle in the vicinity of the traffic control signal.

14. The safety system for approaching a traffic light according to claim 13 wherein the RFID interrogator electrically connects to the logic module such that the logic module detects that the RFID interrogator has detected a responding signal from an emergency vehicle.

15. The safety system for approaching a traffic light according to claim 14 wherein each of the plurality of strobe lights is a strobe light;

wherein the plurality of strobe lights generate the visible signals to indicate that an emergency vehicle is in the vicinity of the traffic control signal;

wherein the plurality of strobe lights are mounted on the exterior surface of the traffic control signal;

wherein each of the plurality of strobe lights is positioned such that at least one light selected from the plurality of strobe lights is visible from any direction relative to the traffic control signal.

16. The safety system for approaching a traffic light according to claim 15 wherein each of the plurality of speakers is a transducer;

wherein each of the plurality of speakers is a speaker;

wherein each of the plurality of speakers receives an electric signal from the logic module;

wherein each of the plurality of speakers generates an audible sound;

wherein the plurality of speakers generate the audible signals to indicate that an emergency vehicle is in the vicinity of the traffic control signal;

wherein each of the plurality of speakers is mounted on the exterior surface of the traffic control signal;

wherein each of the plurality of speakers is positioned such that generated audible signal is audible from any direction relative to the traffic control signal.

17. The safety system for approaching a traffic light according to claim 16 wherein the signal control structure override signal is an electrical signal;

wherein the logic module transmits the signal control structure override signal to the signal control structure when the logic module detects that the RFID interrogator has detected a responding signal from the emergency vehicle;

wherein the signal control structure override signal initiates the signal control structure to halt the movement of all traffic at the point supervised by the traffic control signal.

* * * * *